US008529081B2

(12) United States Patent
Gibson et al.

(10) Patent No.: US 8,529,081 B2
(45) Date of Patent: Sep. 10, 2013

(54) HEADLAMP DEVICE WITH HOUSING PROVIDING THERMAL MANAGEMENT

(75) Inventors: Ronald S. Gibson, Valencia, CA (US); Deepanjan Mitra, Irvine, CA (US); Ammar Burayez, Silverado, CA (US)

(73) Assignee: SureFire, LLC, Fountain Valley, CA (US)

( * ) Notice: Subject to any disclaimer, the term of this patent is extended or adjusted under 35 U.S.C. 154(b) by 142 days.

(21) Appl. No.: 13/006,312

(22) Filed: Jan. 13, 2011

(65) Prior Publication Data

US 2011/0261556 A1 Oct. 27, 2011

Related U.S. Application Data

(63) Continuation-in-part of application No. 12/766,655, filed on Apr. 23, 2010, now Pat. No. 8,395,058.

(51) Int. Cl.
*F21V 21/084* (2006.01)
*F21V 29/00* (2006.01)

(52) U.S. Cl.
USPC ..... 362/105; 362/294

(58) Field of Classification Search
None
See application file for complete search history.

(56) References Cited

U.S. PATENT DOCUMENTS

| | | | | |
|---|---|---|---|---|
| 4,654,757 | A | 3/1987 | Birkhauser | |
| D320,667 | S * | 10/1991 | Smith | D26/39 |
| D394,720 | S | 5/1998 | Yuen | |
| 6,229,101 | B1 | 5/2001 | Sekiya et al. | |
| 6,262,477 | B1 | 7/2001 | Mahulikar et al. | |
| D470,615 | S | 2/2003 | Janice et al. | |
| 6,736,529 | B1 * | 5/2004 | Lee | 362/105 |
| D492,052 | S | 6/2004 | Schnell | |
| 6,903,271 | B2 | 6/2005 | Pearson et al. | |
| 7,116,061 | B2 | 10/2006 | Kim et al. | |
| D554,782 | S * | 11/2007 | Shiu | D26/39 |
| D566,310 | S | 4/2008 | Alessio | |
| D583,971 | S | 12/2008 | Castellucci et al. | |
| 7,513,660 | B2 | 4/2009 | Spartano et al. | |
| 7,568,812 | B1 | 8/2009 | Kumthampinij et al. | |
| D600,379 | S * | 9/2009 | Petzl | D26/39 |
| D614,786 | S | 4/2010 | Lee | |
| D615,225 | S * | 5/2010 | DeBrunner | D26/39 |

(Continued)

FOREIGN PATENT DOCUMENTS

| | | | |
|---|---|---|---|
| DE | 10 2008 056923 | A1 | 5/2010 |
| WO | WO 2010/054924 | A1 | 5/2010 |

OTHER PUBLICATIONS

U.S. Appl. No. 29/383,208, filed Jan. 13, 2011, Gibson.

*Primary Examiner* — Anh Mai
*Assistant Examiner* — Britt D Hanley
(74) *Attorney, Agent, or Firm* — Haynes and Boone, LLP

(57) ABSTRACT

A lighting device with thermal management may be, for example, a headlamp device that includes a light source and a housing. The housing includes a first portion comprising a first set of external surfaces adapted to operate as a first heat sink to dissipate heat from within the first portion. The light source is disposed within the first portion. The housing also includes a second portion comprising a second set of external surfaces adapted to operate as a second heat sink to dissipate heat from within the second portion. Substantially all external surfaces of the of housing are adapted to be exposed to ambient air when the headlamp device is in use and are included in the first and second sets of external surfaces. Methods and other lighting devices are also provided.

25 Claims, 14 Drawing Sheets

(56) References Cited

U.S. PATENT DOCUMENTS

| | | | | |
|---|---|---|---|---|
| D615,680 | S | 5/2010 | Kim | |
| D620,160 | S | 7/2010 | Kang et al. | |
| D623,783 | S | 9/2010 | Christianson et al. | |
| D625,863 | S | 10/2010 | Kingston et al. | |
| 2002/0141197 | A1 | 10/2002 | Petroski | |
| 2005/0023034 | A1 | 2/2005 | Ishida et al. | |
| 2008/0205036 | A1* | 8/2008 | Tarter et al. | 362/105 |
| 2009/0001558 | A1 | 1/2009 | Shiau | |
| 2010/0177502 | A1 | 7/2010 | Lau | |
| 2010/0187004 | A1 | 7/2010 | Kawade et al. | |
| 2010/0214766 | A1 | 8/2010 | Hunt | |
| 2010/0277096 | A1 | 11/2010 | Kim | |
| 2010/0277894 | A1 | 11/2010 | Kim | |
| 2011/0261557 | A1 | 10/2011 | Gibson et al. | |

* cited by examiner

HEADLAMP DEVICE WITH HOUSING PROVIDING THERMAL MANAGEMENT

CROSS-REFERENCE TO RELATED APPLICATIONS

This application is a continuation-in-part of U.S. patent application Ser. No. 12/766,655 filed Apr. 23, 2010, which is incorporated herein by reference in its entirety.

TECHNICAL FIELD

This application relates to circuit boards and, more particularly, to a metal core circuit board modified with conductive pins.

BACKGROUND

Light emitting diodes (LEDs) are rapidly replacing conventional sources of illumination such as incandescent bulbs. Because an LED is typically a discrete circuit, it is common to mount LEDs on circuit boards so that the LED may receive the appropriate circuit leads. Although LEDs are more efficient than conventional illumination sources, they still emit an appreciable amount of heat during operation. Metal core printed circuit boards are thus used to provide thermal management for mounted LEDs. Such a board would include a conductive core such as aluminum that is coated with a one or more dielectric layers. A printed or lithographed foil layer, such as copper, overlays the dielectric layer. The foil layer forms the electrical leads to couple to the LED. The dielectric layer(s) act to insulate the foil layer and the coupled circuits from the conductive core. Although the core is thus electrically isolated, it is still thermally connected to the LED such that it acts as an adequate heat sink.

But conventional metal core board technology is problematic for applications that must pass electrical leads through the board. For example, such a need is present in LED flashlight applications. In that regard, consider the construction of a conventional flashlight—there is an elongated cylindrical battery housing that holds the batteries and allows a user to handle the device. The battery housing connects to a flashlight head that includes a lens or transparent cover held by a bezel. At the base of the bezel is the circuit board holding the LED(s).

The circuit board is mounted within the flashlight orthogonally to the optical axis of the lens. However, such a circuit board arrangement then forms a natural barrier to the necessary electrical leads for coupling between the batteries and the board's printed foil layer (and ultimately to the LED). Conductive pins passing through the circuit board to couple to the printed foil layer need insulation from the metal core in the board to prevent the batteries from shorting out through the resulting conduction in the metal core. But an insulated pin then requires an extra soldering step to couple to the printed foil layer, which increases manufacturing costs. Alternatively, wires can be passed through a gap between the edge of the board and the bezel, which still requires an extra soldering step and requires a bigger installation space.

Accordingly, there is a need in the art for metal core circuit board configurations that enable efficient construction and soldering of leads such as conductive pins to pass through the board.

SUMMARY

In accordance with a first embodiment of the invention, a circuit board assembly is provided that includes: a metal core circuit board having a principal surface for mounted circuits and at least one through hole extending between the principal surface and a backside surface for the metal core circuit board; and an at least one conductive pin, wherein each conductive pin includes a shaft extending through a corresponding through hole and a pin cap abutting the principal surface adjacent the corresponding through hole such that an undercutting for the pin cap circumferentially surrounds the corresponding through hole.

In accordance with a second embodiment of the invention, a method of manufacturing a circuit board assembly is provided that includes: providing a circuit board having a through hole at least partially surrounded by solder; inserting a shaft for a conductive pin into the through hole such that a cap for the conductive pin abuts the solder wherein the through hole has a diameter sufficiently exceeding a diameter for shaft such that the shaft is electrically isolated from a metal core for the circuit board, and wherein the cap has an inner undercut portion surrounding the through hole and an outer remaining portion abutting the solder; and heating the solder such that it reflows and electrically couples the pin to a metal foil layer on the circuit board.

In accordance with a third embodiment of the invention, a flashlight is provided that includes a flashlight head including a lens held by a bezel; a metal core circuit board secured to the bezel, the circuit board including a light emitting diode (LED) for illumination through the lens; and a battery housing for holding batteries for powering the LED through a conductive path that includes a first conductive pin having a shaft extending through a first through hole in the circuit board, the first conductive pin including a pin cap abutting a principal surface of the circuit board adjacent the first through hole such that an undercutting for the pin cap circumferentially surrounds the first through hole.

In accordance with a fourth embodiment of the invention, a headlamp device is provided that includes a light source; and a housing comprising: a first portion comprising a first set of external surfaces adapted to operate as a first heat sink to dissipate heat from within the first portion of the housing, wherein the light source is disposed within the first portion of the housing, a second portion comprising a second set of external surfaces adapted to operate as a second heat sink to dissipate heat from within the second portion of the housing, and wherein substantially all external surfaces of the of housing are adapted to be exposed to ambient air when the headlamp device is in use and are included in the first and second sets of external surfaces.

In accordance with a fifth embodiment of the invention, a method of operating a headlamp device comprising a light source, a housing, and a user control is provided that includes operating the user control to turn on the light source which causes the headlamp device to: dissipate heat from within a first portion of the housing by a first set of external surfaces of the first portion of the housing which are adapted to operate as a first heat sink, wherein the light source is disposed within the first portion of the housing, and dissipate heat from within a second portion of the housing by a second set of external surfaces of the second portion of the housing which are adapted to operate as a second heat sink; and wherein substantially all external surfaces of the of housing are adapted to be exposed to ambient air when the headlamp device is in use and are included in the first and second sets of external surfaces.

In accordance with a sixth embodiment of the invention, a method is provided that includes assembling a headlamp device comprising: a light source; and a housing comprising: a first portion comprising a first set of external surfaces adapted to operate as a first heat sink to dissipate heat from within the first portion of the housing, wherein the light source is disposed within the first portion of the housing, a second portion comprising a second set of external surfaces adapted to operate as a second heat sink to dissipate heat from within the second portion of the housing, and wherein substantially all external surfaces of the of housing are adapted to be exposed to ambient air when the headlamp device is in use and are included in the first and second sets of external surfaces.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
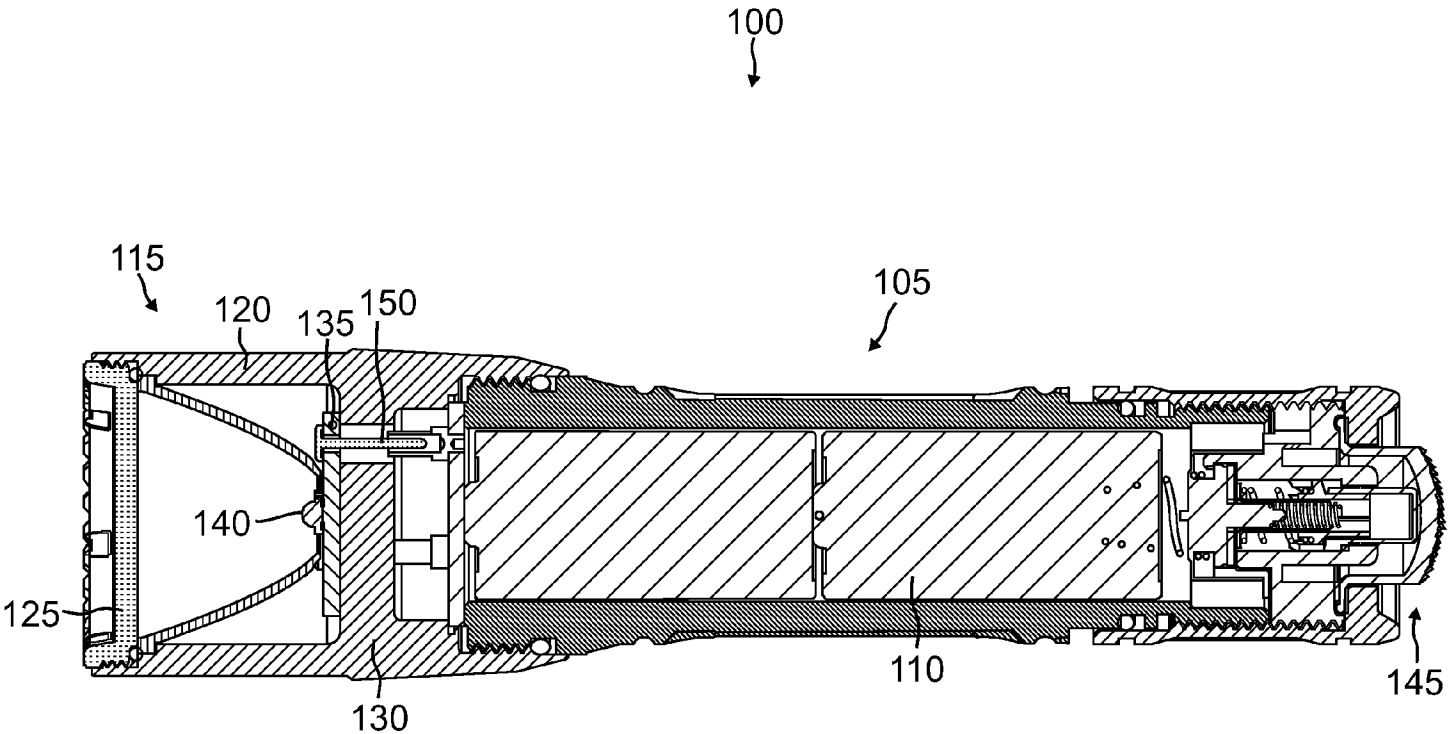
FIG. 1 is a longitudinal cross sectional view of a flashlight including a metal core board transversed by undercut conductive pins in accordance with an embodiment of the invention.

The following metal core circuit board configuration will be discussed with regard to an example flashlight embodiment. However, it will be appreciated that such a configuration can be widely applied to other applications besides flashlights where there is a need to pass conductors through the metal core circuit board to electrically couple to the printed foil layer. Turning now to the drawings, FIG. 1 shows a longitudinal cross section of a flashlight 100 including a battery housing 105 holding batteries 110.

A flashlight head 115 includes a bezel 120 holding a lens 125 and forming a backing plate 130. A metal core circuit board 135 mounts to backing plate 130 so that heat from an LED 140 may dissipate as discussed previously. To turn the flashlight on and off, a user activates a switch 145. With the switch on, current from the batteries flows through one or more conductive pins 150 to the LED.

Figure 2:
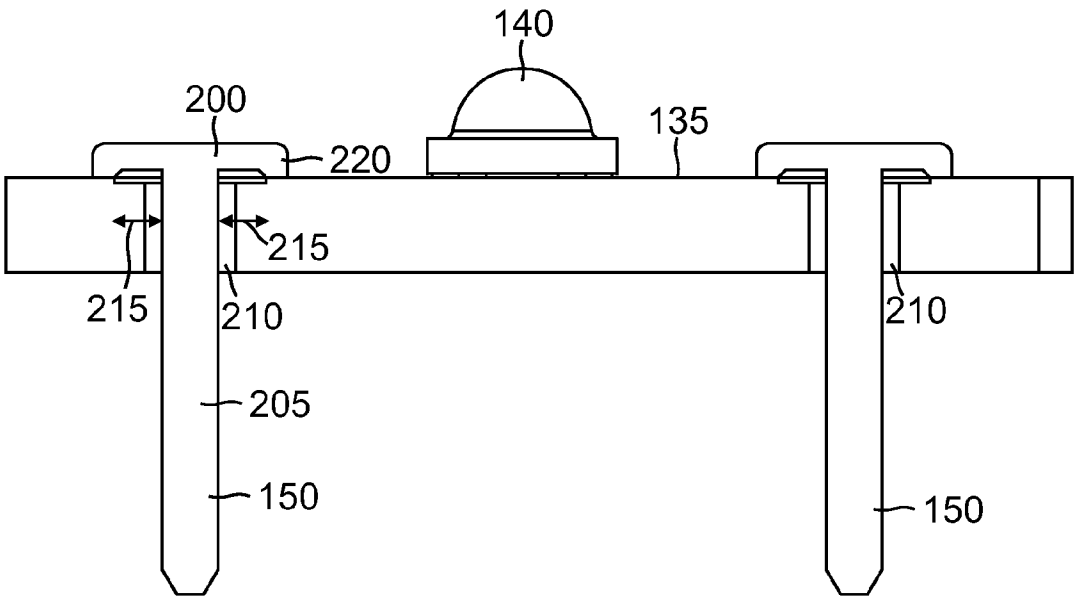
FIG. 2 is a cross-sectional view of the metal core board of FIG. 1 and the associated LED and undercut conductive pins in accordance with an embodiment of the invention.

In some embodiments, a single conductive pin 150 is sufficient in that a ground connection to LED 140 is available through an appropriate coupling through the metal core circuit board 135 to bezel 120 and from bezel 120 to battery housing 105 back to batteries 110. However, a ground connection through a second conductive pin as shown in FIG. 2 may also be provided.

Additional conductive pins may be provided as necessary for coupling control signals or other desired signals to circuits on metal core board 135. For example, FIG. 2 illustrates an embodiment in which two conductive pins 150 pass through metal core board 135. Regardless of the number of desired pins, each pin 150 has a cap 200 and a shaft or body 205. The diameter of pin shaft 205 is less than a diameter of corresponding through holes 210 in metal core circuit board 135. For example, in one embodiment pin shaft 205 has a diameter of 40 mil (one-thousandth of an inch) but through hole 210 is 65 mil in diameter. In this fashion, a clearance of approximately 12 mil circumferentially surrounds pin shaft 205 when the shaft is centered in through hole 210 such that pin 150 is electrically isolated from metal core circuit board 135.

Pin cap 200 is circumferentially undercut around pin shaft 205 such that an annular portion 215 on an underside of cap 200 is also electrically isolated from metal core board 135. To provide an electrical coupling, some portion of cap 200 connects through solder to a foil layer (discussed further with regard to FIG. 3*c*) on metal core board 135. Thus, an outer annulus 220 of cap 200 is not undercut to allow this electrical contact. In that regard, one pin 150 may serve as the power source for LED 140 (as coupled through an appropriate lead formed in the foil layer) whereas a remaining pin 150 acts as the ground lead for LED 140.

Figure 3A:
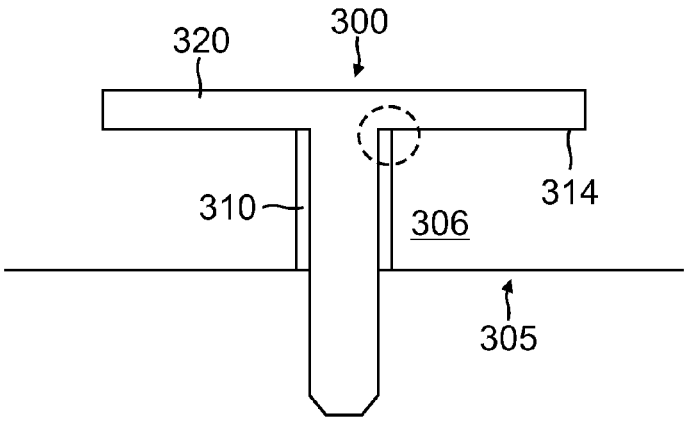
FIG. 3*a* is a cross-sectional view of a conductive pin transecting a metal core board without any undercutting in accordance with an embodiment of the invention.

Note the advantages of such a coupling to LED 140—no insulation layer or sleeve is necessary for through holes 210. Although an insulating sleeve is not necessary, metal core circuit board 135 can include such sleeves if desired. For example, consider FIG. 3*a*, which illustrates a conductive pin 300 extending though a metal core circuit board 305 and electrically isolated by a sleeve 310 (rather than just free space) without any undercutting on a lower surface 314 of a pin cap 320.

Figure 3B:
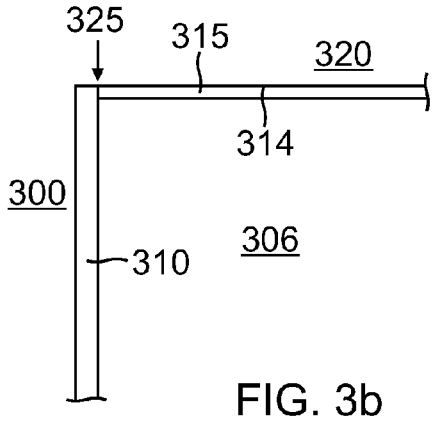
FIG. 3*b* is a close-up cross-sectional view of the through hole and pin junction for FIG. 3*a* in accordance with an embodiment of the invention.

As seen in the close-up view of FIG. 3*b*, undersurface 314 for a cap 320 on pin 300 is electrically isolated from a metal core 306 in board 305 by a relatively-thin dielectric coating 315. As discussed previously, such a dielectric layer isolates leads formed in a printed foil layer on metal core boards from the conducting metal core. However, due to the relative thinness of dielectric layer 315 (typically in a range of 1 to 3 mils), there is a considerable risk of shorting through to metal core 306 at an edge 325 of layer 315.

For example, there may be minor defects along edge 325 that allow metal-to-metal contact between cap 320 and metal core 306. Alternatively, the voltage between cap 320 and core 306 may cause arcing across such short distances. Thus, the mere presence of an insulating sleeve 310 does not provide adequate isolation between cap 320 and core 306 at edge 325 of dielectric layer 315 as compared to embodiments with a circumferential undercutting on the pin cap as discussed with regard to FIG. 2.

Figure 3C:
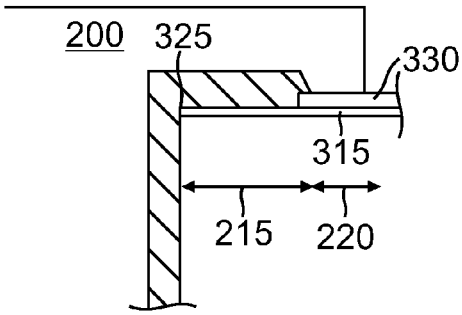
FIG. 3*c* is a close-up cross-sectional view of the through hole and pin junction for FIG. 2 in accordance with an embodiment of the invention.

In that regard, consider the cross-sectional view of undercut cap 200 at the junction with dielectric layer edge 325 as seen in FIG. 3*c*. As discussed with regard to FIG. 2, cap 200 is undercut in annular region 215 such that only an outer annular non-undercut region 220 has electrical contact with a printed foil layer 330 that overlays dielectric layer 315. Note that annular undercut region 215 for cap 200 is displaced from dielectric layer 315 by the depth of the undercutting and the thickness of foil layer 330.

In one embodiment, annular undercut region 215 is undercut to a depth of 5 mil. Foil thickness may range from 3 to 5 mil such that the cap lower surface in annular undercut region 215 is displaced from dielectric layer 315 by 8 to 10 mil in such an embodiment. In contrast, as seen in FIG. 3*b*, pin cap 300 without any undercutting is merely isolated from metal core 306 by the (typically 1 to 3 mil) thickness of dielectric layer 315. Accordingly, the undercutting for pin cap 200 substantially increases the robustness with regard to preventing electrical shorts between the pin and the metal core.

Figure 4:
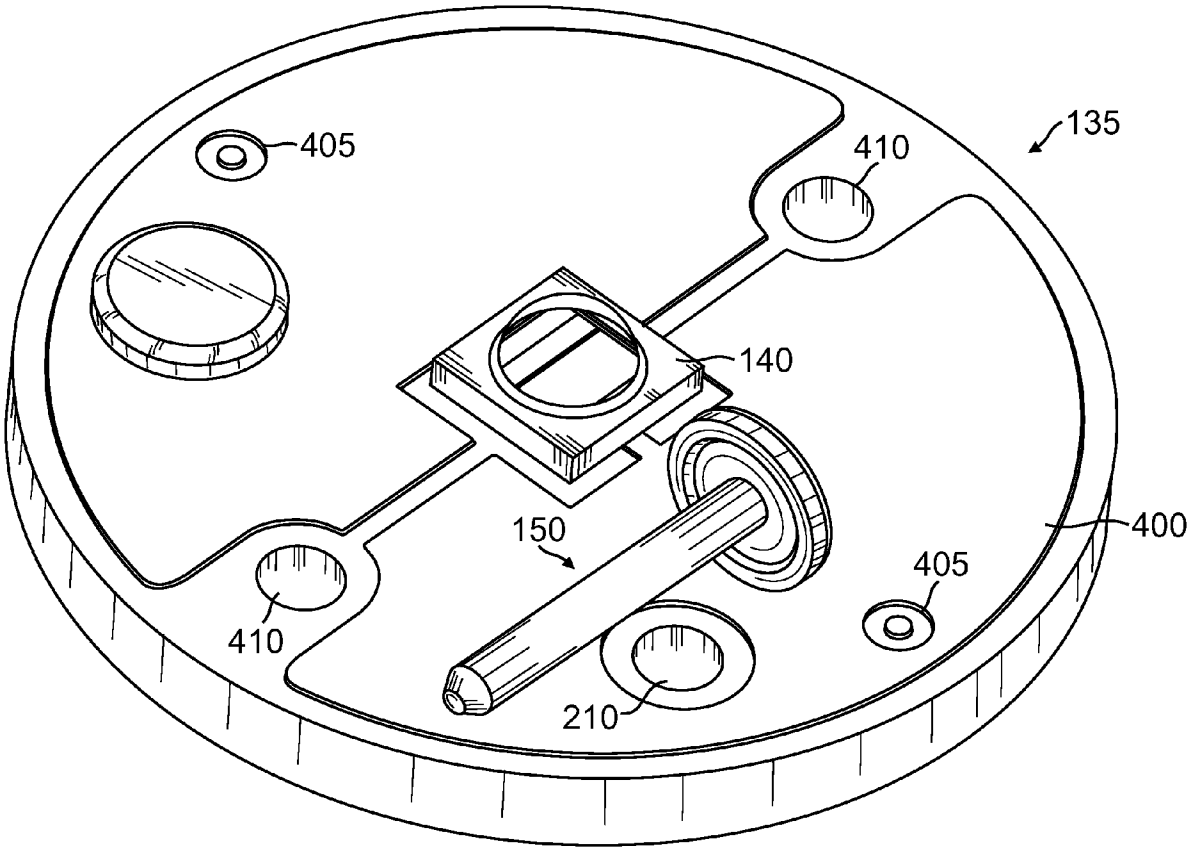
FIG. 4 is a perspective view of a metal core board and associated LED and undercut conductive pins in accordance with an embodiment of the invention.

A method for manufacturing circuit board 135 with pins 150 will now be discussed. As seen in FIG. 4, a solder mask 400 is deposited over the printed foil layer. Mask 400 has annular openings about through holes 210 so that an annular ring of solder/flux paste may be placed around through holes 210 on the foil layer to eventually solder to corresponding outer annular regions 220 of pin cap 200 discussed earlier. Solder/flux paste is also laid down in an appropriate pattern for coupling to LED 140. The leads within printed foil layer 330 that couple from pins 150 to LED 140 are underneath solder mask 400 in FIG. 4 and are thus not visible.

The solder/flux paste will not only promote fusion but also is adhesive. Thus, when pins 150 and LED 140 are placed onto the solder/flux paste layers, these components will tend to adhere to metal core circuit board 135 before the solder is reflowed in a reflow oven. For illustration purposes, a pin 150 is left unmounted in FIG. 4.

To assist robotic placement of pins 150 into through holes 210, solder mask 400 may include one or more fiducials 405. Despite the presence of fiducials 405, there is some tolerance with regard to an exact centering of each pin in a corresponding through hole. Thus, it is desirable that the difference between the pin shaft diameter and the through hole diameter accommodate this tolerance.

For example, suppose the tolerance is plus or minus 5 mil. If one desires at least a 5 mil separation between the pin shaft and the through hole wall, the through hole diameter should be at least 20 mil greater than the pin shaft diameter to satisfy the desired separation. In general, the diameter difference between the pin shaft and the through hole will depend upon the tolerance provided by the placement method for centering the pins within each through hole upon insertion.

After the pins and LED have been placed upon the circuit board, the resulting assembly may be heated in a reflow oven such that the pins and LED are soldered to the foil layer. In that regard, note that the solder ring surrounding through holes 210 in FIG. 4 overlies a corresponding ring of metal formed in the printed foil layer. As the solder melts in the oven, surface tension will thus tend to further center each pin in its respective through hole. In this fashion, lower tolerances are accommodated with regard to an initial centering of each pin by a robot.

It will be appreciated however that although an automated assembly lowers manufacturing costs, the pins could also be placed manually in their corresponding through holes. Referring back to FIG. 1, the resulting circuit board assembly may be fastened to the bezel backing plate 130 using, for example, thermally-conductive glue. To enable convenient grasping of metal core circuit board 135 by a robotic arm during assembly, board 135 includes recesses (or through holes) 410 as shown in FIG. 4. A robotic aim can thus insert fingers into recesses 410 to move metal core circuit board 135 such as when metal core circuit board 135 is placed into a reflow oven, or when placed into the bezel during later assembly.

Referring again to FIG. 2, it may observed that to prevent electrical shorts to the metal core beneath the dielectric layer, the undercut portion 215 need merely circumferentially surround the pin shaft and have some sufficient width or lateral extent such as 35 mil. This undercut need not form a circular annulus but such a shape is naturally achieved through a rotating machining process such a lathe to form the undercut. Similarly, the pin cap need not be circular but again such a shape is convenient. Pins 150 may be constructed of a suitable conductive metal such as brass, copper, or aluminum. To aid in the establishment of electrical contact, pins 150 may be gold plated.

Although a metal core circuit board construction has been discussed with regard to an example flashlight embodiment, such a construction may be incorporated into other lighting devices as well. For example, in various embodiments, metal core circuit board 135 may be provided in a headlamp device.

Figure 5:
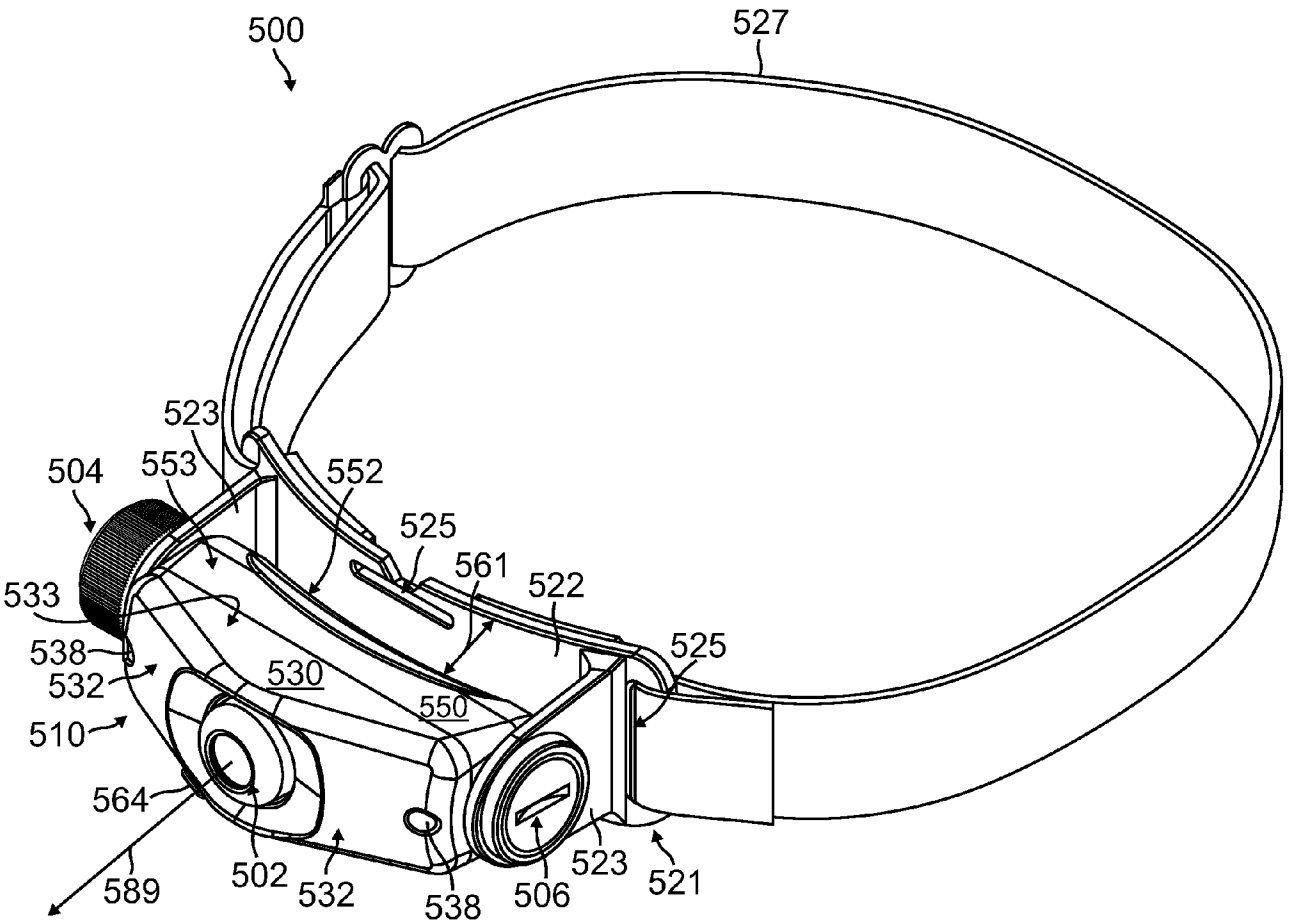
FIGS. 5-6 are perspective views of a headlamp device implemented with a headlamp assembly in accordance with embodiments of the invention.
Figure 6:
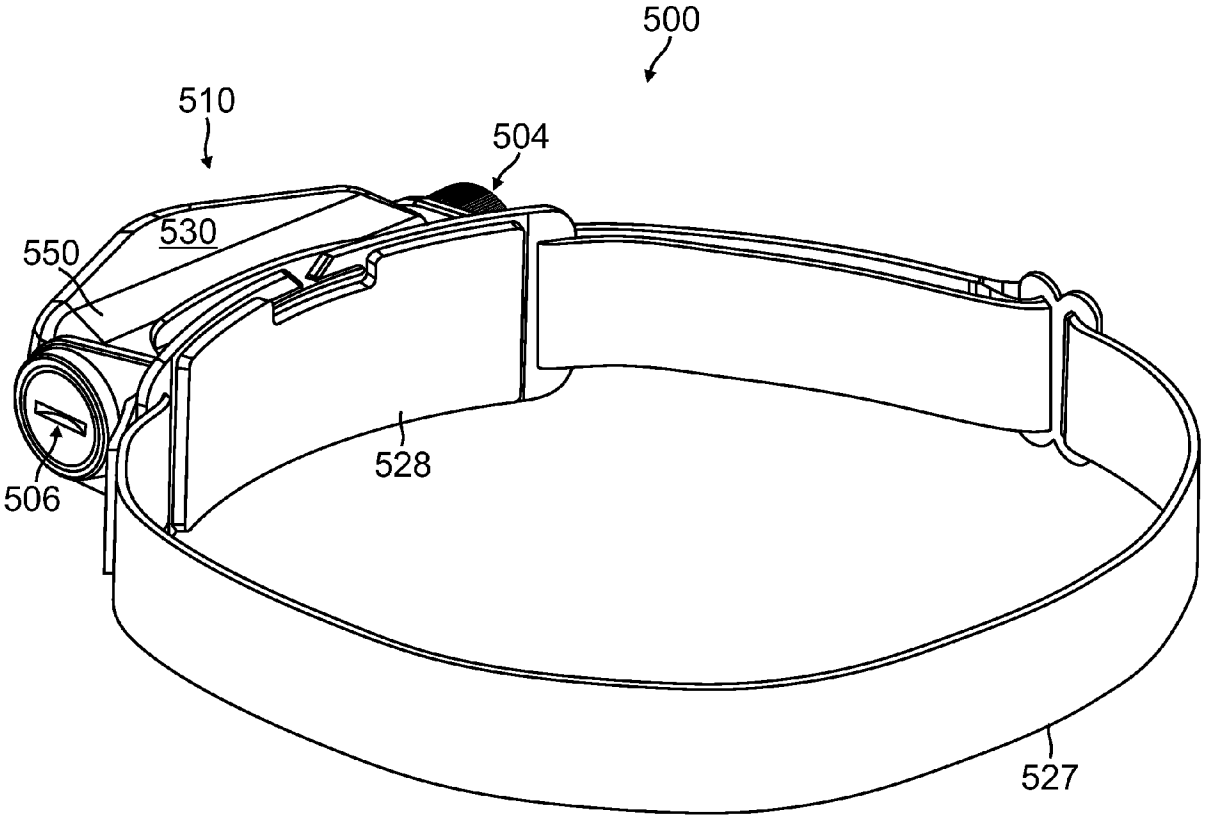
Figure 7:
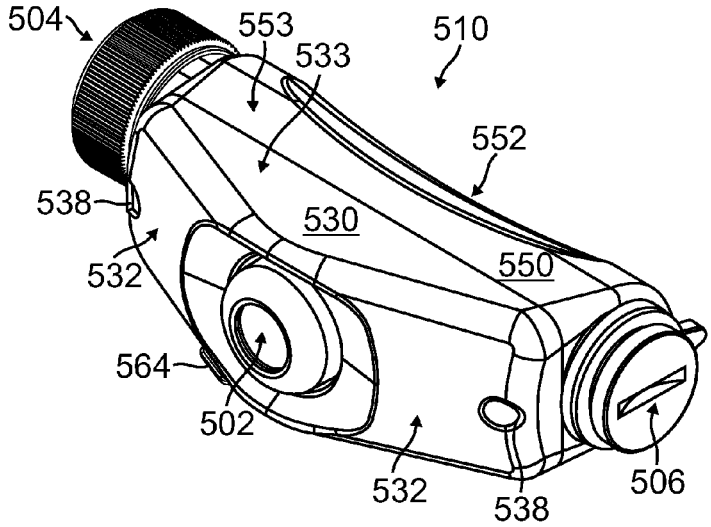
FIGS. 7-14 are various views of the headlamp assembly of FIGS. 5-6 in accordance with embodiments of the invention.
Figure 8:
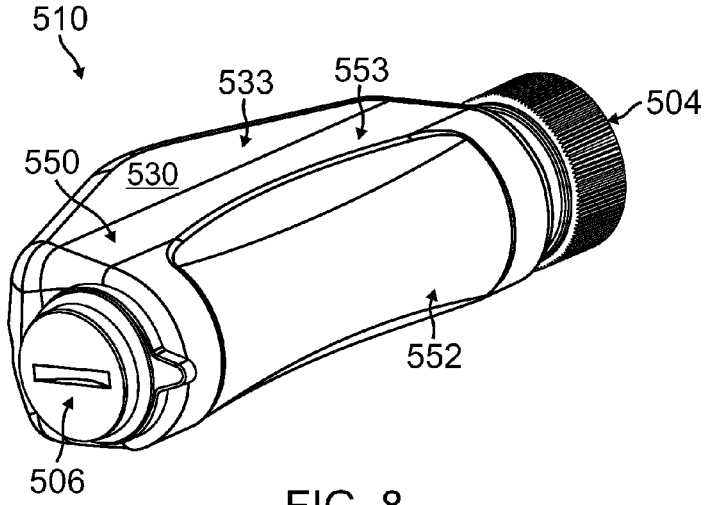
Figure 9:
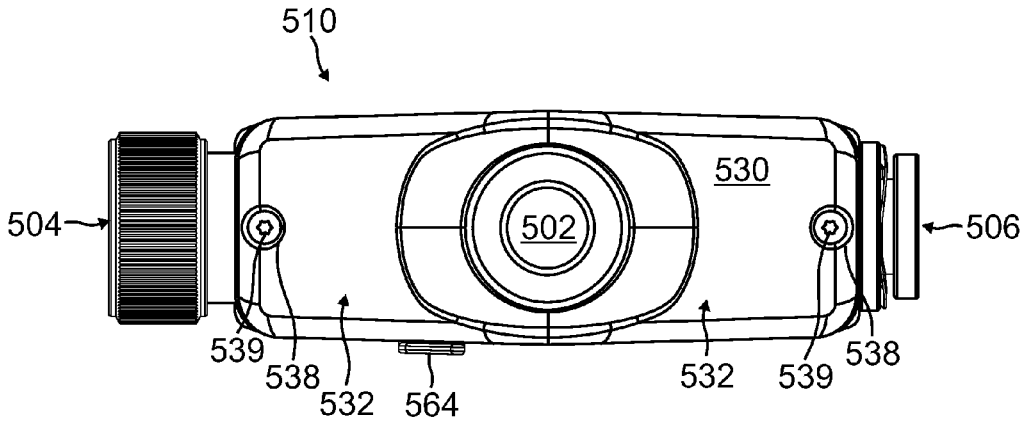
Figure 10:
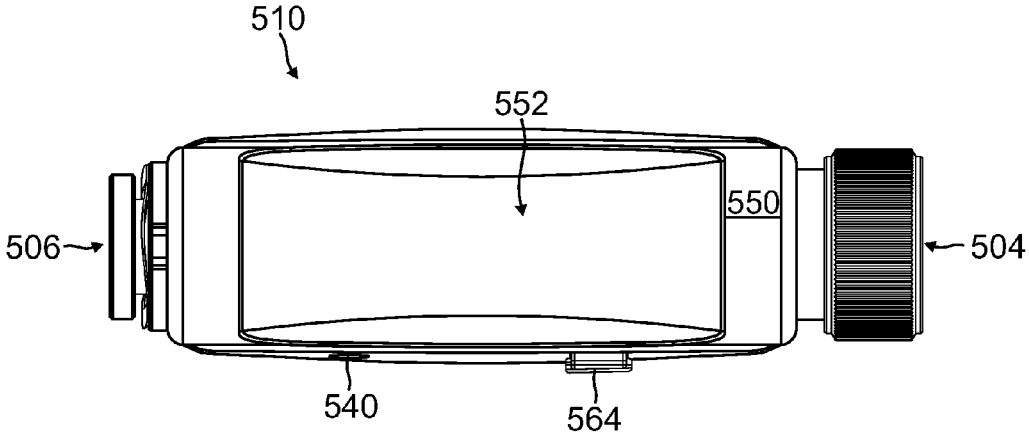
Figure 11:
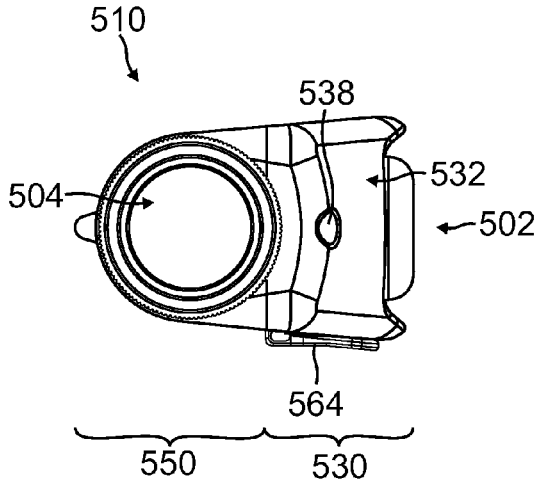
Figure 12:
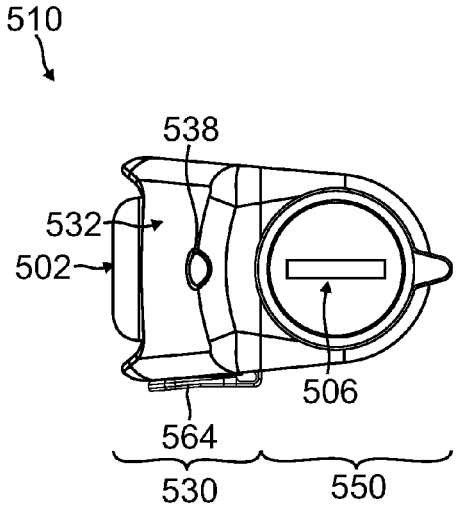
Figure 13:
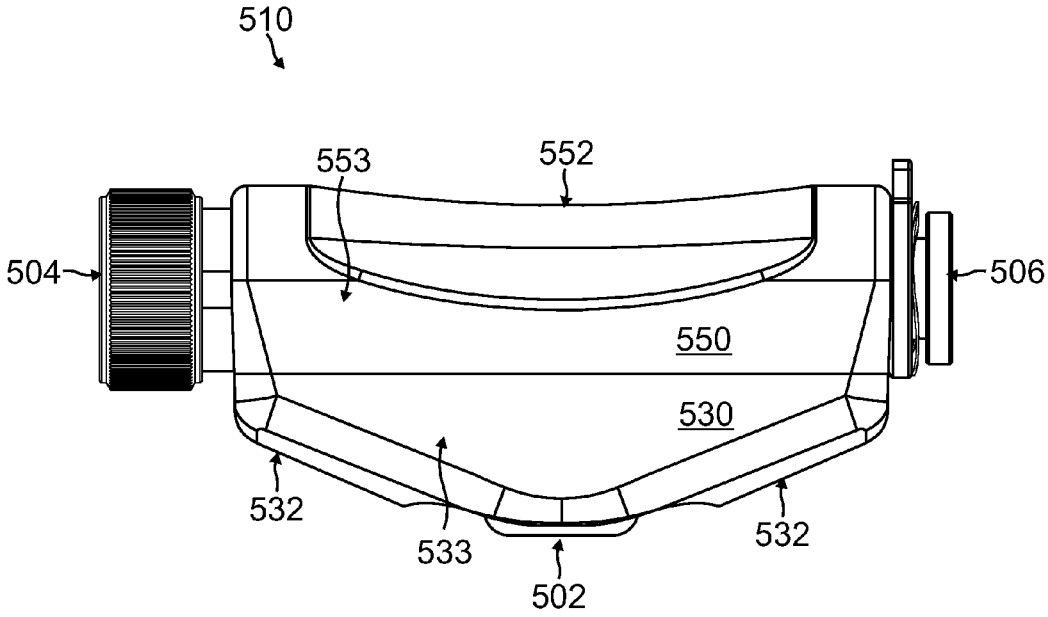
Figure 14:
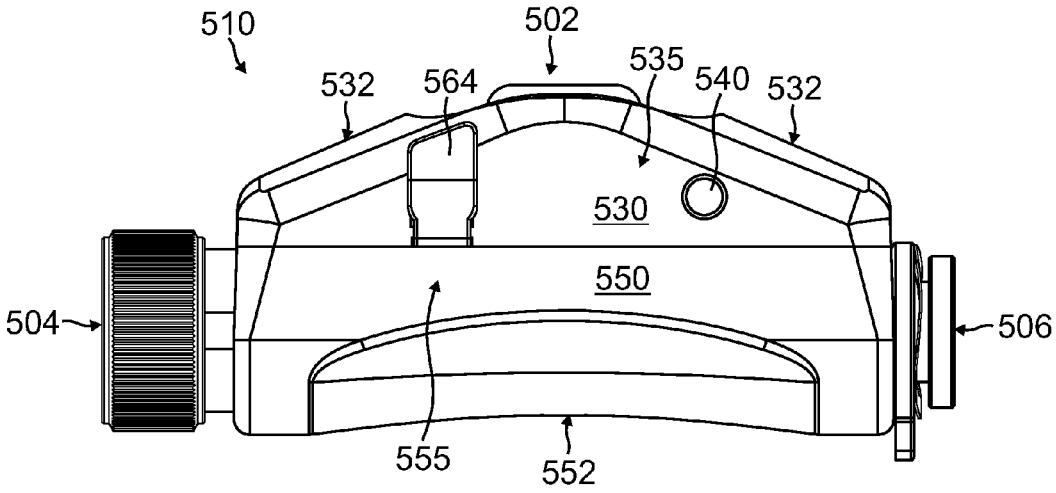
Figure 15:
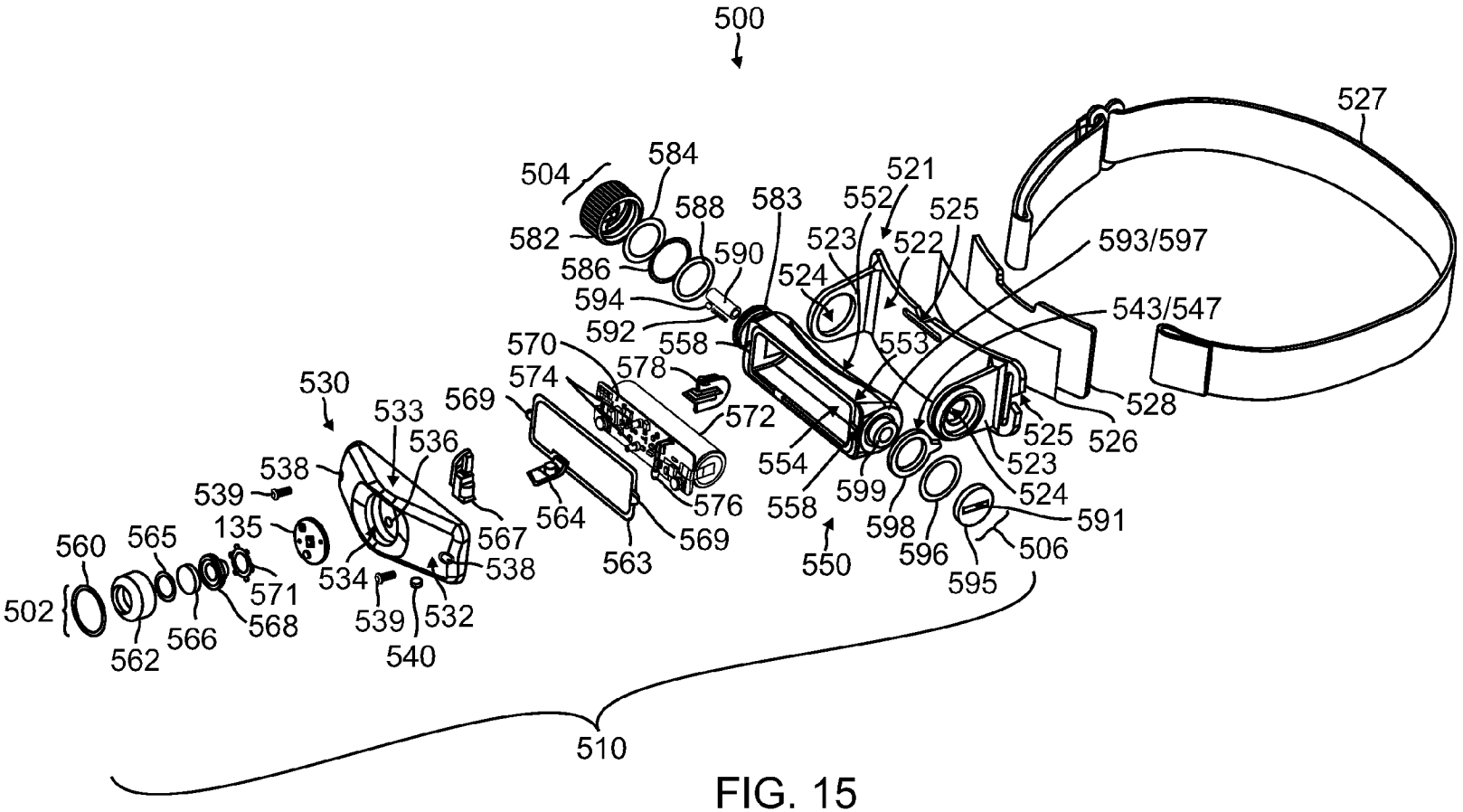
FIG. 15 is an exploded view of the headlamp device of FIGS. 5-6 in accordance with an embodiment of the invention.
Figure 16:
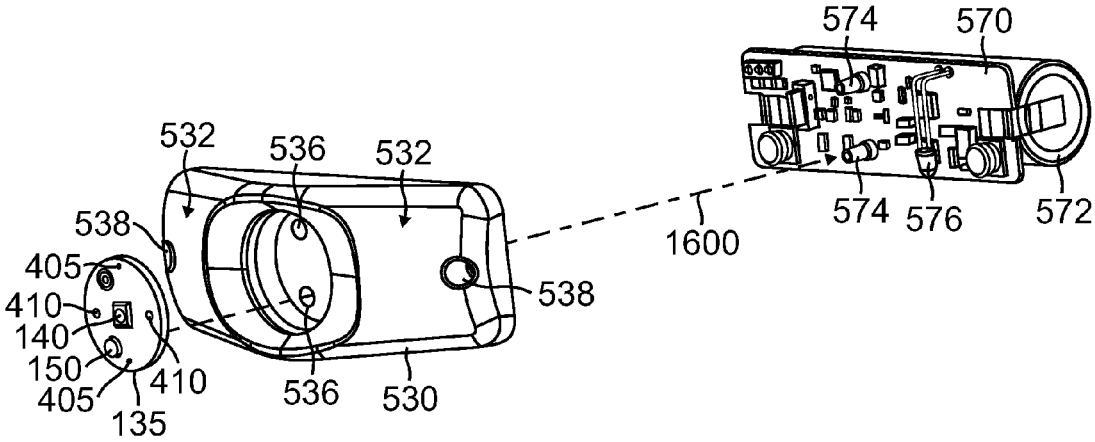
FIGS. 16-17 are exploded views of portions of the headlamp assembly of FIGS. 5-6 showing the insertion of a metal core board in accordance with embodiments of the invention.
Figure 17:
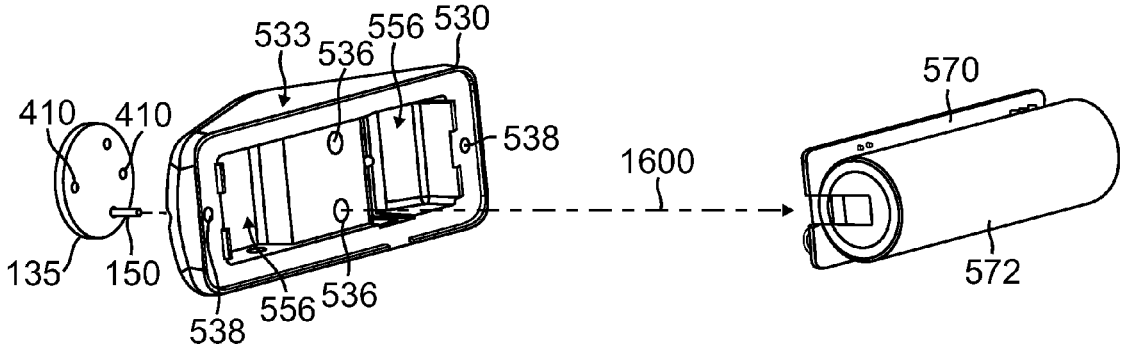
Figure 18:
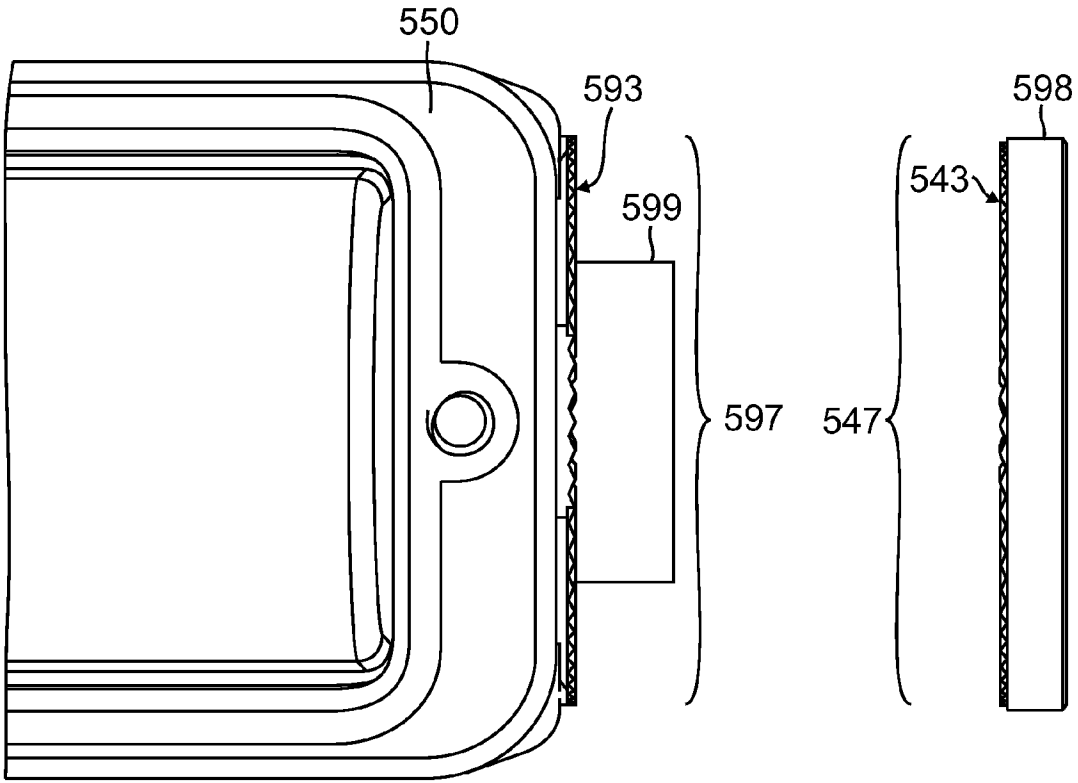
FIG. 18 is view of a ratchet mechanism of the headlamp device of FIGS. 5-6 in accordance with an embodiment of the invention.
Figure 19:
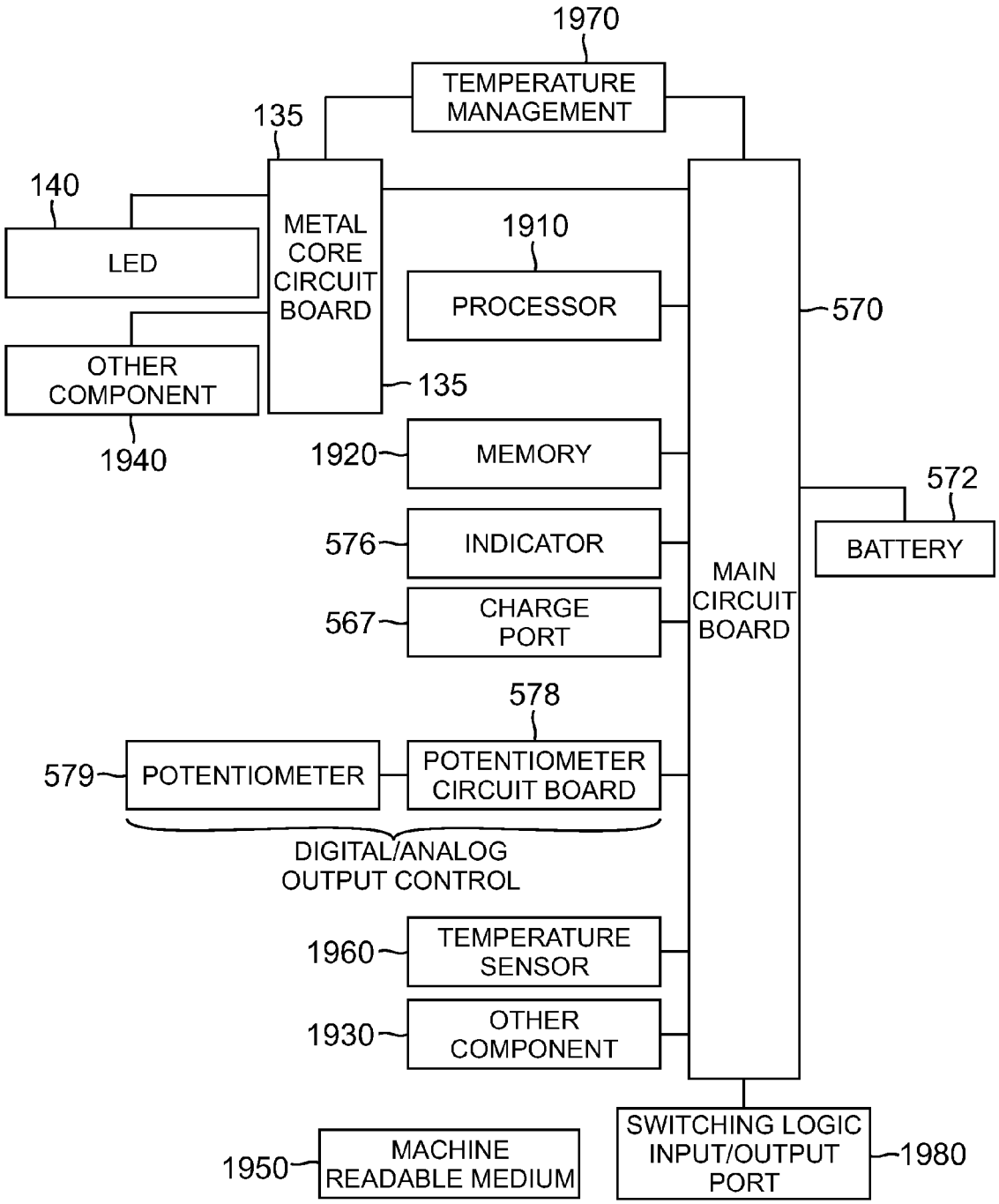
FIG. 19 is block diagram of various components of the headlamp assembly of FIGS. 5-6 in accordance with an embodiment of the invention.

FIGS. 5-6 are perspective views of a headlamp device 500 implemented with a headlamp assembly 510 in accordance with embodiments of the invention. FIGS. 7-14 are various views of headlamp assembly 510 in accordance with embodiments of the invention. FIG. 15 is an exploded view of headlamp device 500 in accordance with an embodiment of the invention. FIGS. 16-17 are exploded views of portions of headlamp assembly 510 showing the insertion of metal core circuit board 135 in accordance with embodiments of the invention. FIG. 18 is view of a ratchet mechanism of headlamp device 500 in accordance with an embodiment of the invention. FIG. 19 is block diagram of various components of headlamp assembly 510 in accordance with an embodiment of the invention.

In various embodiments, headlamp device 500 may be implemented to provide thermal (e.g., heat) management in which heat is dissipated in a generally forward direction and/or away from the user's head. In this regard, headlamp assembly 510 may be implemented with a housing comprising two portions (e.g., first and second housing portions, such as a front housing portion 530 and a rear housing portion 550), each of which may operate as a heat sink to dissipate heat and provide cooling for various portions of headlamp assembly 510. Front housing portion 530 may operate as a heat sink primarily for an optical assembly 502 (e.g., including metal core circuit board 135, LED 140, one or more pins 150, and/or other components), a charge port 567, an indicator 576, and/or other components generally located within front housing portion 530. Rear housing portion 550 may operate as a heat sink primarily for a main circuit board 570, a battery 572, and/or other components generally located within rear housing portion 550.

In one embodiment, front housing portion 530 and rear housing portion 550 may have little or no direct contact with each other. For example, a gasket 563 may be interposed between front housing portion 530 and rear housing portion 550. As a result, front housing portion 530 and rear housing portion 550 may effectively operate as two separate heat sinks with little heat transfer between them. As a result, heat associated from components disposed within front housing portion 530 may be substantially dissipated by front housing portion 530, and heat associated from components disposed within rear housing portion 550 may be substantially dissipated by rear housing portion 550.

In various embodiments, front housing portion 530 and rear housing portion 550 may be implemented using a lightweight thermally conductive alloy, magnesium, magnesium alloy, metal, and/or other appropriate heat dissipating materials. Advantageously, substantially all external surfaces of front housing portion 530 and rear housing portion 550 may be exposed to the operating environment (e.g., ambient air) and thus may be used to dissipate heat in a short thermal path from headlamp assembly 510 to the operating environment. For example, front housing portion 530 provides top and bottom surfaces 533 and 535, respectively, as well as front surfaces 532, all of which may operate as a heat sink. Similarly, rear housing portion 550 provides top and bottom surfaces 553 and 555, respectively, as well as rear surface 552, all of which may operate as a heat sink. In one embodiment, substantially all surfaces provided by front housing portion 530 and rear housing portion 550 may be exposed to the operating environment when headlamp device 500 is in use. Substantially all of such surfaces may be substantially elongated and substantially planar with large surface areas to provide large amounts of active cooling area for heat dissipation through convection and radiation. In one embodiment, front housing portion 530 and rear housing portion 550 may be shaped to maximize the ratio of active cooling surface area to mass, wherein the active cooling surface area of headlamp assembly 510 is the product of the heat transfer coefficient (h) and the combined exposed surface area (A) of front housing portion 530 and rear housing portion 550.

In use, front surfaces 532 may be particularly efficient for dissipating heat and providing cooling for headlamp assembly 510. In this regard, when the user moves forward while headlamp device 500 is positioned on the user's head, front surfaces 532 may be pushed forward through the air. As such, front surfaces 532 provide a broad heat sink that receives direct airflow from the ambient air as the user moves forward. As a result, front housing portion 530 may efficiently dissipate heat and provide cooling (e.g., convective cooling) for various components of headlamp assembly 510.

In addition, headlamp assembly 510 may be offset from the user's head. In this regard, an air gap may be provided between rear surface 552 and the user's head to reduce the amount of dissipated heat felt by the user. In one embodiment shown in FIG. 5, the air gap is identified by arrows 561 which denote the space between rear surface 552 of rear housing 550 and a base 522 of a cradle 521 (e.g., base 522 may be positioned in proximity to the user's head when a strap 527 is positioned around the user's head).

In one embodiment, the thermal management features provided by front housing portion 530 and rear housing portion 550 permit LED 140 to operate at higher temperatures, and thus higher brightness levels, than conventional headlamps.

Various components of headlamp device 500 shown in FIGS. 5-19 will now be further described. As shown, headlamp assembly 510 includes front housing portion 530, rear housing portion 550, optical assembly 502, a knob assembly 504, and a pivot assembly 506.

Optical assembly 502 includes an o-ring 560, a reflector housing 562, a lens gasket 565, a lens 566, a reflector 568 (e.g., a total internal reflection (TIR) reflector), a retaining ring 571, and metal core circuit board 135. Optical assembly 502 may be inserted into a recess 534 in front housing portion 530. Light emitted by LED 140 (e.g., or any other desired type of light source provided on metal core circuit board 135 or otherwise provided) may be projected through reflector 568 and lens 566 toward the front of headlamp assembly 510 generally in the direction of an arrow 589 (see FIG. 5). As discussed, metal core circuit board 135 may be used to dissipate heat associated with LED 140. For example, metal core circuit board 135 may contact front housing portion 530 and thus may dissipate heat to front housing portion 530 which in turn dissipates the heat to the operating environment.

As shown in FIGS. 16-17, front housing portion 530 includes apertures 536 which may receive one or more pins 150 protruding in the direction of an arrow 1600. One or more pin receivers 574 may be provided on main circuit board 570 to receive pins 150 and provide conductive paths from pins 150 to other components on main circuit board 570. As a result, LED 140 and/or other components on metal core circuit board 135 may receive electrical power (e.g., from battery 572) and/or control signals (e.g., from other components on main circuit board 570) through such pins 150 while pins 150 remain electrically isolated from metal core circuit board 135 as discussed.

In some embodiments, a single pin 150 is sufficient in that a ground connection to LED 140 is available through an appropriate coupling to battery 572 through metal core circuit board 135, front housing portion 530, screws 539, rear housing portion 550, and main circuit board 570. In other embodiments, a ground connection through a second conductive pin 150 may also be provided. In other embodiments, additional pins 150 may be provided as desired for coupling control signals or other desired signals between main circuit board 570 and metal core circuit board 135.

Headlamp assembly 510 also includes charge port 567 configured to receive electrical power from an external power source. Charge port 567 may pass such electrical power to main circuit board 570 to charge battery 572 (e.g., where battery 572 is implemented as a rechargeable battery). In another embodiment, battery 572 may be implemented as a non-rechargeable battery. Headlamp assembly 510 also includes a charge port cover 564 which may be used to conceal charge port 567 when not in use.

As discussed, headlamp assembly 510 also includes gasket 563 that may be interposed between front housing portion 530 and rear housing portion 550. In one embodiment, charge port cover 564 may be integrated with gasket 563 as a single structure.

As discussed, headlamp assembly 510 also includes main circuit board 570 connected to battery 572. In this regard, battery 572 may be used to power various components of main circuit board 570 and metal core circuit board 135.

Main circuit board 570 includes indicator 576 (e.g., an LED or other appropriate light source) which may identify the amount of power remaining in battery 572. In this regard, headlamp assembly 510 may also include a window 540 in bottom surface 535 of front housing portion 530 to permit the user to view indicator 576.

Front housing portion 530 may be joined with rear housing portion 550 through the engagement of screws 539. In this regard, screws 539 may be inserted through apertures 538 in front housing portion 530, apertures 569 in gasket 563, and apertures 558 in rear housing portion 550. While assembled, front housing portion 530 and rear housing portion 550 may contact complementary sides of gasket 563; main circuit board 570, battery 572, and a potentiometer circuit board 578 may reside substantially within a cavity 554 of rear housing portion 550; and charging port 567, indicator 576, and other components of main circuit board 570 may reside substantially within cavities 556 of front housing portion 530.

Knob assembly 504 includes a knob 582, an o-ring 584, a lock ring 586, an o-ring 588, a potentiometer connector 590, a spring 592, and a ball 594. Knob assembly 504 may be mounted on an extension 583 of rear housing portion 550 having threads to engage with complementary threads of knob 582. Knob assembly 504 may be used to operate LED 140. For example, the user may rotate knob 582 to selectively adjust light output by LED 140 (e.g., to selectively turn LED 140 on or off, to selectively change the brightness (e.g., level or intensity) of light emitted by LED 140, to flash LED 140 in a pattern (e.g., a strobe pattern or other pattern), and/or to perform other adjustments). In one embodiment, rotation of knob 582 may cause potentiometer connector 590 to rotate a potentiometer 579 (see FIG. 19) on potentiometer circuit board 578 which provides appropriate signals to LED 140 and/or other components of main circuit board 570 to operate LED 140 as desired. In other embodiments, other appropriate types of user controls may be provided and used as desired.

Pivot assembly 506 includes a pivot screw 595, a washer 596, and a ratchet member 598. Pivot assembly 506 may be mounted on an extension 599 of rear housing portion 550. Pivot screw 595 includes a slot 591 which may receive a tool (e.g., a screwdriver, fingernail, or other appropriate tool) to tighten pivot assembly 506.

Headlamp device 500 also includes cradle 521 and strap 527 which may be used together to mount headlamp assembly 510 in proximity to the user's head. In this regard, cradle 521 includes base 522, support members 523, apertures 524, and apertures 525. Strap 527 may wrap around the user's head and may be connected to cradle 521 through one or more of apertures 525. Extensions 583 and 599 of rear housing portion 550 may pass through apertures 524 to permit cradle 521 to hold headlamp assembly 510.

Headlamp device 500 also includes a pad 528 (e.g., made of breathable material with moisture wicking capability, such as BREATHE-O-PRENE® of Accumed Innovative Technologies, LLC, or other appropriate material) which may contact the user's head when wearing headlamp device 500. Pad 528 may be connected to base 522 of cradle 521 by a pad attachment 526.

In one embodiment, headlamp assembly 510 may be rotated relative to cradle 521 by a ratchet mechanism shown in FIG. 18. Rear housing portion 550 includes an annular surface 597 having teeth 593 disposed around extension 599. An annular surface 547 of ratchet member 598 facing annular surface 597 includes complementary teeth 543. When ratchet member 598 is positioned against rear housing portion 550, teeth 593 may engage with teeth 543 to keep headlamp assembly 510 fixed in position relative to cradle 521. When the user applies sufficient pressure to dislodge teeth 543 and 593 from each other, headlamp assembly 510 may rotate substantially in the direction of the applied pressure until teeth 543 and 593 reengage with each other. Accordingly, it will be appreciated that headlamp assembly 510 may be selectively ratcheted up or down to rotate optical assembly 502 to any desired position to adjust the angle of light projected by LED 140 in relation to the user's head.

Referring now to the block diagram of FIG. 19, various components of headlamp assembly 510 and their associated connections are shown. In addition to components previously discussed herein, headlamp assembly 510 may further include additional components connected to main circuit board 570 such as one or more processors 1910, one or more memories 1920, one or more temperature sensors 1960, one or more temperature management blocks 1970, one or more switching logic input/output ports 1980, and one or more other components 1930 (e.g., which may be desired for particular implementations). Also, headlamp assembly 510 may further include one or more other components 1940 (e.g., which may be desired for particular implementations) connected to metal core circuit board 135.

Processor 1910 may execute various instructions stored in memory 1920 or stored on one or more machine readable mediums 1950 (e.g., non-transitory storage mediums on which instructions such as software, microcode, or other instructions may be stored) to perform various operations as may be desired in various implementations. In various embodiments, processor 1910 may be implemented by one or more logic circuits, programmable logic devices (PLDs), general purpose processors, application-specific integrated circuits (ASICs), or other appropriate circuitry.

In one embodiment, processor 1910 may operate LED 140 in response to the user's operation of knob 582 (e.g., which may cause potentiometer 579 to rotate).

In one embodiment, processor 1910 may operate LED 140 in response to control signals received by temperature sensor 1960. In this regard, processor 1910 and temperature sensor 1960 may provide a control circuit to efficiently drive LED 140 to full output levels and reduce the output level of LED 140 in response to control signals provided by temperature sensor 1960 if the temperature of headlamp assembly 510 exceeds a threshold temperature. Temperature management block 1970 (e.g., temperature sensor, digital circuit, analog circuit, and/or other appropriate components) may be used in combination with and/or in place of processor 1910 and/or temperature sensor 1960 to efficiently drive LED 140 as may be desired in particular implementations.

In one embodiment, potentiometer 579 and/or potentiometer circuit board 578 may be replaced and/or supplemented by a digital and/or analog output control (e.g., another type of user control or machine control) as may be desired in particular implementations.

One or more switching logic input/output ports 1980 may be used to interface with additional controls (e.g., switches or other types of controls that may be provided on a lighting device, such as switches mounted on surfaces, bodies, tailcaps, or other locations) that provide appropriate control signals to main circuit board 570 to support any of the various operations described herein.

Although various particular examples of the operation of processor 1910 and other components have been described, any desired features may be implemented by executing appropriate instructions by processor 1910. Where desired, processor 1910 and appropriate components may be replaced or supplemented with other circuits or components to provide the various operations as desired.

Where applicable, various embodiments provided by the disclosure can be implemented using hardware, software, or combinations of hardware and software. Also where applicable, the various hardware components and/or software components set forth herein can be combined into composite components comprising software, hardware, and/or both without departing from the spirit of the disclosure. Where applicable, the various hardware components and/or software components set forth herein can be separated into sub-components comprising software, hardware, or both without departing from the spirit of the disclosure. In addition, where applicable, it is contemplated that software components can be implemented as hardware components, and vice-versa.

Software in accordance with the disclosure, such as program code and/or data, can be stored on one or more machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

Embodiments described above illustrate but do not limit the invention. For example, a manufacturing method was discussed with regard to a reflow soldering process but it will be appreciated that other soldering techniques could be used to connect the pin cap to the board's printed foil layer. In addition, although flashlight 100 and headlamp device 500 have been discussed, the features described herein may be used with other types of lighting devices as may be desired in particular applications. Also, although LED 140 has been discussed, any desired number or combination of LEDs, filament lamps, arc lamps, or other types of light sources may be used as may be desired in particular applications. Thus, it should also be understood that numerous modifications and variations are possible in accordance with the principles of the present invention. Accordingly, the scope of the invention is defined only by the following claims.

What is claimed is:

1. A headlamp device comprising:

a circuit board;

a light source mounted to the circuit board; and a housing comprising:

a first portion comprising a recess provided in a front surface of the first portion, a first cavity defined by a rear surface of the first portion, and a first set of external surfaces adapted to operate as a first heat sink to dissipate heat from the recess and the first cavity, wherein the light source and the circuit board are disposed within the recess, a second portion comprising a second cavity substantially separate from the first cavity, and a second set of external surfaces adapted to operate as a second heat sink to dissipate heat from the second cavity, wherein substantially all external surfaces of the housing are adapted to be exposed to ambient air when the headlamp device is in use and are included in the first and second sets of external surfaces, and wherein the housing is adapted to be offset from a head of a user by an air gap when the headlamp device is in use and positioned on the head of the user.

2. The headlamp device of claim 1, wherein the first set of external surfaces comprise a first substantially elongated and substantially planar external top surface of the housing, a first substantially elongated and substantially planar external bottom surface of the housing, and a substantially elongated and substantially planar external front surface of the housing; and wherein the second set of external surfaces comprise a second substantially elongated and substantially planar external top surface of the housing, a second substantially elongated and substantially planar external bottom surface of the housing, and an external rear surface of the housing.

3. The headlamp device of claim 1, further comprising a gasket disposed between the first and second portions of the housing and adapted to limit heat transfer between the first and second portions of the housing.

4. The headlamp device of claim 1, further comprising a cradle comprising a base, a plurality of support members, and apertures in the support members, wherein the housing comprises a plurality of extensions adapted to pass through the apertures to permit the cradle to hold the housing.

5. The headlamp device of claim 4, further comprising a ratchet member comprising a first annular surface comprising a first set of teeth adapted to selectively engage with a second set of teeth of a second annular surface on the housing to permit the housing to be selectively positioned relative to the cradle to adjust an angle of light projected from the headlamp device.

6. The headlamp device of claim 4, further comprising a strap adapted to hold the cradle in proximity to the head of the user.

7. The headlamp device of claim 1, wherein:

the circuit board comprises a metal core circuit board comprising a principal surface, a backside surface, a metal core between the principal surface and the backside surface, and a through hole extending through the metal core and between the principal surface and the backside surface; and the headlamp device further comprises a conductive pin electrically isolated from the metal core and adapted to pass electrical power through the metal core circuit board to the light source.

8. The headlamp device of claim 7, wherein the pin comprises a shaft and a pin cap, wherein the shaft is extended through the through hole, wherein the pin cap abuts the principal surface adjacent the through hole such that an undercutting for the pin cap circumferentially surrounds the corresponding through hole.

9. The headlamp device of claim 8, wherein the metal core circuit board further comprises a printed foil layer proximate the principal surface, wherein a non-undercut outer annulus for the pin cap is in electrical contact with the printed foil layer.

10. The headlamp device of claim 9, wherein the light source is in electrical contact with the printed foil layer.

11. The headlamp device of claim 1, wherein the housing comprises a magnesium alloy.

12. The headlamp device of claim 1, wherein the light source is an LED.

13. The headlamp device of claim 1, wherein the second portion of the housing is adapted to enclose a power source within the second cavity to provide electrical power for the light source.

14. The headlamp device of claim 13, further comprising:

the power source; and a charge port adapted to charge the power source.

15. A method of operating a headlamp device comprising a circuit board, a light source mounted to the circuit board, a housing, and a user control, the method comprising:

operating the user control to turn on the light source which causes the headlamp device to:

dissipate heat from a recess and a first cavity of a first portion of the housing by a first set of external surfaces of the first portion which are adapted to operate as a first heat sink, wherein the light source and the circuit board are disposed within the recess, and wherein the recess is provided in a front surface of the first portion and the first cavity is defined by a rear surface of the first portion, and dissipate heat from a second cavity of a second portion of the housing by a second set of external surfaces of the second portion which are adapted to operate as a second heat sink, wherein the second cavity is substantially separate from the first cavity;

wherein substantially all external surfaces of the housing are adapted to be exposed to ambient air when the headlamp device is in use and are included in the first and second sets of external surfaces; and wherein the housing is adapted to be offset from a head of a user by an air gap when the headlamp device is in use and positioned on the head of the user.

16. The method of claim 15, wherein:

the circuit board comprises a metal core circuit board comprising a principal surface, a backside surface, a metal core between the principal surface and the backside surface, and a through hole extending through the metal core and between the principal surface and the backside surface;

the headlamp device further comprises a conductive pin electrically isolated from the metal core; and the operating causes the conductive pin to pass electrical power through the metal core circuit board to the light source.

17. The method of claim 15, wherein the headlamp device further comprises:

a cradle comprising a base, a plurality of support members, and apertures in the support members, wherein the housing comprises a plurality of extensions adapted to pass through the apertures to permit the cradle to hold the housing, and a ratchet member comprising a first annular surface comprising a first set of teeth adapted to selectively engage with a second set of teeth of a second annular surface on the housing; and wherein the method further comprises adjusting an angle of light projected from the headlamp device by causing the first and second teeth to selectively engage with each other to selectively position the housing relative to the cradle.

18. The method of claim 15, wherein the second portion of the housing is adapted to enclose a power source within the second cavity to provide electrical power for the light source.

19. A method comprising:

assembling a headlamp device comprising:

a circuit board;

a light source mounted to the circuit board; and a housing comprising:

a first portion comprising a recess provided in a front surface of the first portion, a first cavity defined by a rear surface of the first portion, and a first set of external surfaces adapted to operate as a first heat sink to dissipate heat from the recess and the first cavity, wherein the light source and the circuit board are disposed within the recess, a second portion comprising a second cavity substantially separate from the first cavity, and a second set of external surfaces adapted to operate as a second heat sink to dissipate heat from the second cavity, wherein substantially all external surfaces of the housing are adapted to be exposed to ambient air when the headlamp device is in use and are included in the first and second sets of external surfaces, and wherein the housing is adapted to be offset from a head of a user by an air gap when the headlamp device is in use and positioned on the head of the user.

20. The method of claim 19, wherein:

the circuit board comprises a metal core circuit board comprising a principal surface, a backside surface, a metal core between the principal surface and the backside surface, and a through hole extending through the metal core and between the principal surface and the backside surface; and the headlamp device further comprises a conductive pin electrically isolated from the metal core and adapted to pass electrical power through the metal core circuit board to the light source.

21. The method of claim 19, wherein the headlamp device further comprises:

a cradle comprising a base, a plurality of support members, and apertures in the support members, wherein the housing comprises a plurality of extensions adapted to pass through the apertures to permit the cradle to hold the housing; and a ratchet member comprising a first annular surface comprising a first set of teeth adapted to selectively engage with a second set of teeth of a second annular surface on the housing to permit the housing to be selectively positioned relative to the cradle to adjust an angle of light projected from the headlamp device.

22. The method of claim 19, wherein the second portion of the housing is adapted to enclose a power source within the second cavity to provide electrical power for the light source.

23. The headlamp device of claim 1, wherein:

the circuit board is a first circuit board; and the first and second cavities are substantially separated by a second circuit board of the headlamp device.

24. The method of claim 15, wherein:

the circuit board is a first circuit board; and the first and second cavities are substantially separated by a second circuit board of the headlamp device.

25. The method of claim 19, wherein:

the circuit board is a first circuit board; and the first and second cavities are substantially separated by a second circuit board of the headlamp device.

* * * * *